US006456258B1

(12) United States Patent
Bragg et al.

(10) Patent No.: US 6,456,258 B1
(45) Date of Patent: Sep. 24, 2002

(54) SPRING LOADED ANTENNA MOUNTING SYSTEM AND METHOD

(75) Inventors: Charles R. Bragg, Bothell; Wesley A. Bigelow, Renton, both of WA (US)

(73) Assignee: Harris Broadband Wireless Access, Inc., Bellevue, WA (US)

( * ) Notice: Subject to any disclaimer, the term of this patent is extended or adjusted under 35 U.S.C. 154(b) by 0 days.

(21) Appl. No.: 09/893,010

(22) Filed: Jun. 28, 2001

Related U.S. Application Data

(60) Provisional application No. 60/266,485, filed on Feb. 6, 2001.

(51) Int. Cl.[7] ..... H01Q 1/12; H01Q 3/00

(52) U.S. Cl. ..... 343/892; 343/757; 343/890

(58) Field of Search ..... 343/890, 891, 343/892, 878, 880, 882, 757, 761, 765

(56) References Cited

U.S. PATENT DOCUMENTS

| | | | | |
|---|---|---|---|---|
| 5,963,179 A | * | 10/1999 | Chavez | 343/892 |
| 5,969,692 A | * | 10/1999 | Ishizuka | 343/840 |
| 5,982,340 A | * | 11/1999 | Troche | 343/882 |
| 6,222,504 B1 | * | 4/2001 | Oby | 343/892 |
| 6,264,152 B1 | * | 7/2001 | Bloch et al. | 248/274.1 |
| 6,342,870 B1 | * | 1/2002 | Mehrkens et al. | 343/891 |

* cited by examiner

*Primary Examiner*—Don Wong
*Assistant Examiner*—Hoang Nguyen
(74) *Attorney, Agent, or Firm*—Duane Morris LLP

(57) ABSTRACT

A spring loaded antenna mounting system for the directional antennae of a point-to-multipoint millimeter wave communication system and methods of supporting such antennae for selectively directing the beam thereof. The adjustment of the antenna in two orthogonal directions is disclosed as is a quick connect/disconnect latch for attaching the individual antenna element to the antenna mount.

13 Claims, 9 Drawing Sheets

SPRING LOADED ANTENNA MOUNTING SYSTEM AND METHOD

The present application claims the priority of U.S. Provisional Application Serial No. 60/266,485 filed Feb. 6, 2001 for "Antenna Provisional," the disclosure of which is hereby incorporated herein by reference. This application is related to and is being concurrently filed with commonly assigned U.S. patent application Ser. No. 09/893,013, entitled Geared Antennae Aiming System and Method and Ser. No. 09/893,007, entitled Antennae Quick-Connect System and Method, the disclosures of which are hereby incorporated herein by reference. The present invention relates generally to antennae mounting systems and methods for wireless communication systems, and more specifically to antennae mounting systems and methods for millimeter wave point-to-multipoint communication systems.

BACKGROUND

Point-to-multipoint millimeter wave wireless communication systems are well known and are described, e.g., in the commonly assigned U.S. Pat. No. 6,016,313, entitled "System and Method for Broadband Millimeter Wave Data Communication." Such systems generally consist of one or more hubs each servicing a plurality of remote nodes. The antennae of such systems are highly directional and it is critical to the successful operation of the communication system that each antennae be correctly aimed in both azimuth and elevation. It is accordingly an object of the present invention to provide a novel antennae mounting system which may be selectively aimed in both azimuth and elevation.

Point-to-multipoint communication systems are generally modular with reconfiguration of the coverage of the antennae required, e.g., as the number of subscribers increases within a sector, as subscribers come on line in sectors previously not serviced, as the communication traffic increases within a sector, etc. It is therefore another object of the present invention to provide a novel antennae mounting system and method in which antennae be easily added or moved to effect reconfiguration of the antennae system to accommodate the dynamic changes in the communication system.

Antennae in such systems are often mounted on preexisting structures and there are often physical limitations placed on the construction of new antenna support structures. It is accordingly a further object of the present invention to provide a novel antennae mounting system and method in which the antennae which may be easily and quickly installed on a variety of support structures.

Further, there are difficulties in the installation and aiming of directional antennae, where space is confined and a single installer may be faced with the simultaneous positioning and installation of an antenna at a significant elevation exposed to adverse wind conditions. It is accordingly yet another object of the present invention to provide a novel antennae mounting system and method in which the antennae may be quickly removed or quickly installed and thereafter selectively secured and aimed.

These and other objects and advantages will be readily apparent from the following detailed description of illustrative embodiments when read in conjunction with the appended drawings.

DETAILED DESCRIPTION

Figure 1:
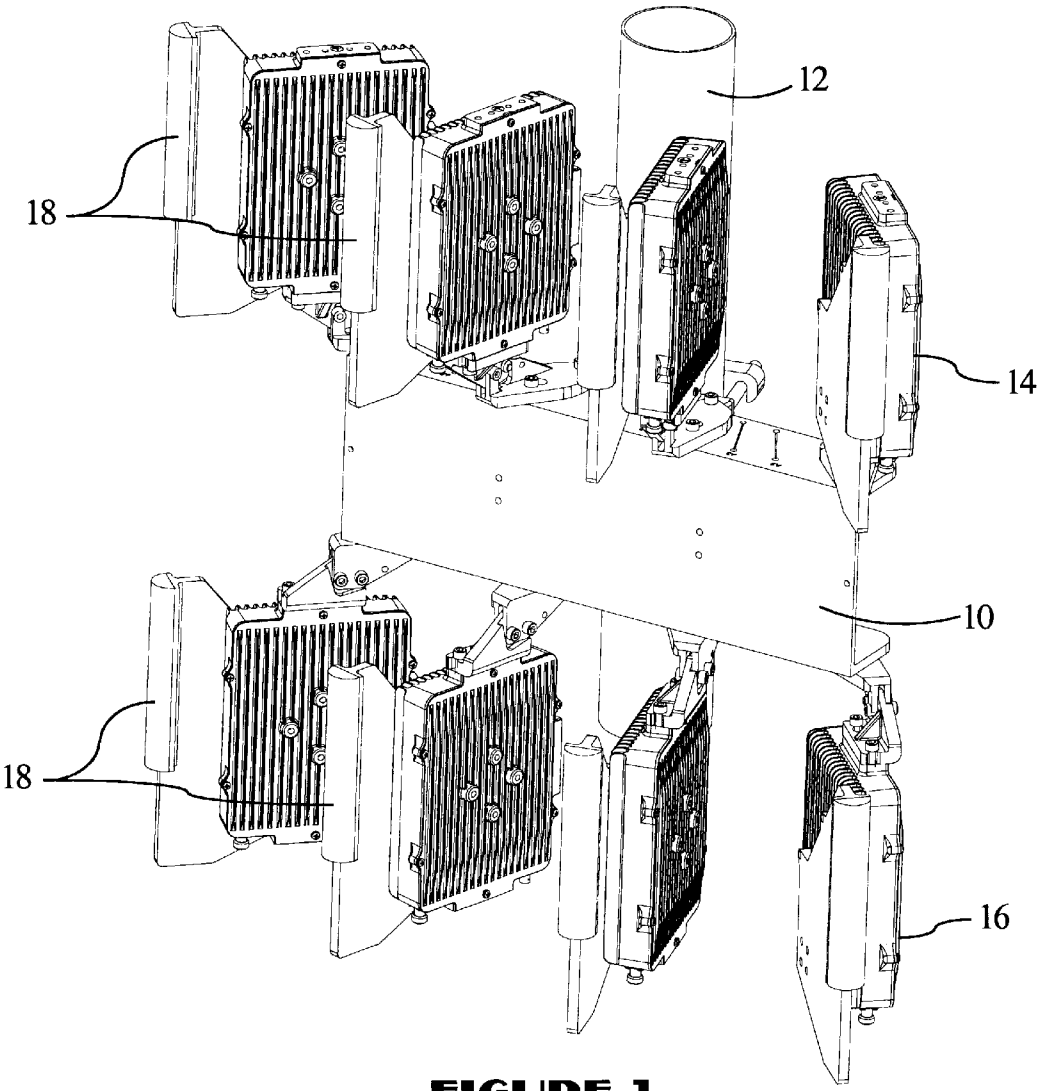
FIG. 1 is a pictorial view of a typical point-to-multipoint hub antenna.

FIG. 1 illustrates a typical hub mounting for plural antennae in a millimeter wave point-to-multipoint wireless communication system. In the embodiment shown, there is a mounting plate 10 secured in a conventional manner to a tubular support 12. Two rows of antennae are illustrated, with the top row 14 having a different degree of elevation than the bottom row 16 to service relatively far and near subscribers respectively. Within each row, each highly directional antennae 18 is offset in azimuth by fifteen degrees to service an area approximately sixty degrees wide.

Figure 2:
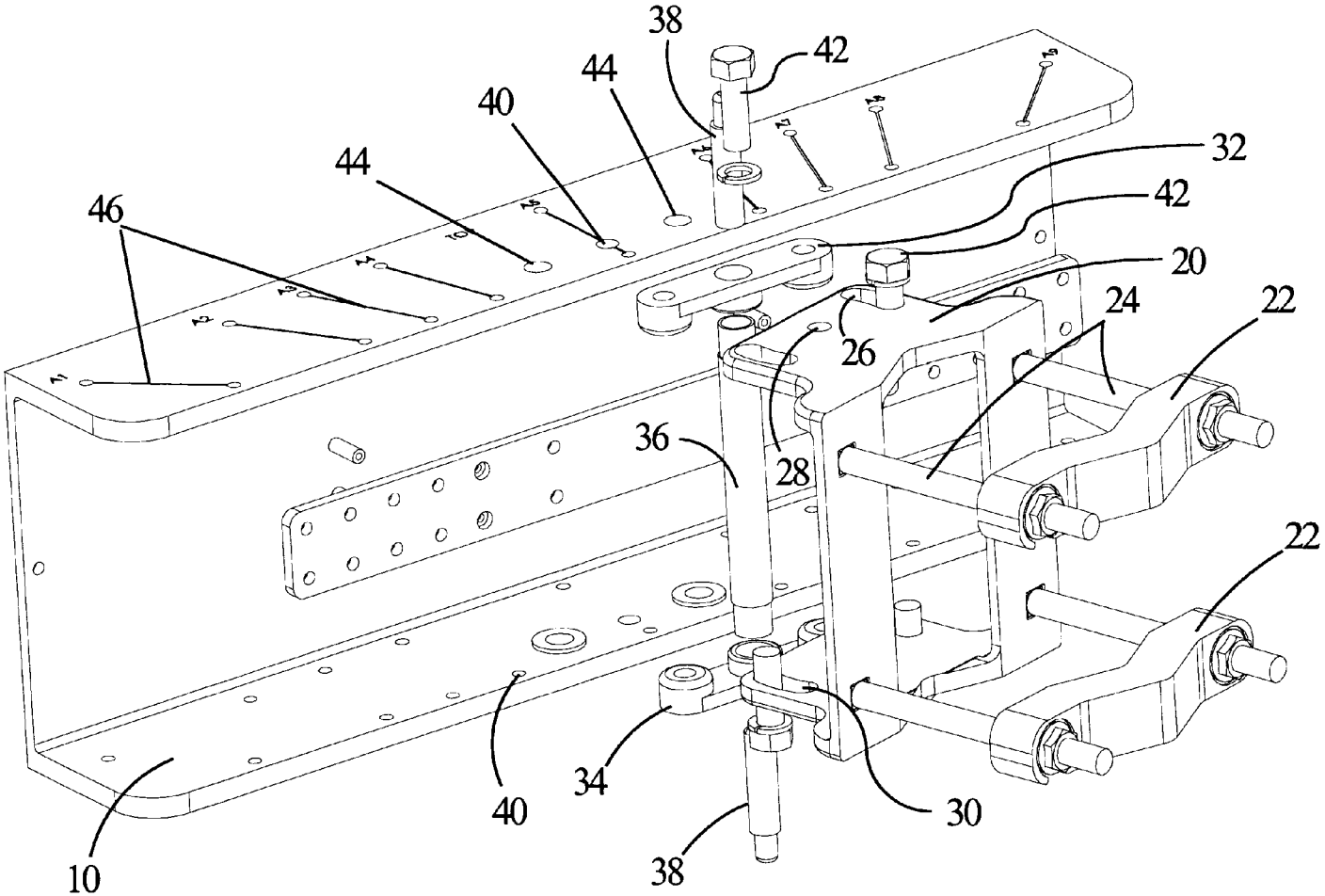
FIG. 2 is an exploded view of one embodiment of the spring loaded antenna mount of the present invention.

As shown in FIG. 2, the mounting plate 10 may be mounted on the pole 12 (not shown) by means of a mounting bracket 20 notched to receive the pole and having two notched backing members 22 secured thereto by way of four bolts 24. The upper and lower flanges 26 of the pole bracket 20 desirably include a central opening 28 and two generally arcuate slots 30 into which are received three protrusions of a top and bottom plate 32,34. Disposed between the flanges 26 is a spring biased pin comprising a central tube 36 which houses a coil spring (not shown) held under relatively slight compression by two end protrusions 38. The protrusions 38 are restrained by any suitable conventional means from completely exiting the tube 36. The pole bracket is relatively easy to install because of its small size and light weight.

With continued reference to FIG. 2, the mounting plate 10 may then be secured to the mounting bracket 20 without the necessity for precise alignment. One of he pins 38 may be depressed into the tube 36 against the pressure of the spring sufficiently to permit the flange of the mounting bracket to slide over the plates 32,34 to align the holes 40 therewith, at which point the pins 38 extend through the holes 40 under the bias of the spring within the tube 36. At this point, the bracket 10 is secured to the mounting bracket 20 and the installer no longer has to deal with the weight of the mounting bracket.

With the pins 38 extended, the bolts 42 may be positioned in the holes 44 in the mounting bracket, through the holes in the plates 32 and the arcuate slots 30. The mounting bracket 10 may then be turned in azimuth relative to the pole bracket 20 and tightened to fix the position thereof relative to the slots 30. Minor adjustments in azimuth may thus be made in the orientation of the mounting bracket 10 without the need for adjusting the mounting of the pole bracket 20 to the pole 12.

As shown in FIG. 2, the flanges of the mounting bracket may be provided with pre-punched holes and lines 46 indicating the alignment of antenna elements relative to the bracket and thus to each other. Installation of the individual antennae to the bracket 10 may thus be facilitated and the relative alignment of the antennae secured without individually aligning the antenna elements.

Note that at no point in the installation is the installer required to deal with the weight of a pre-assembled antenna nor individually adjust the antenna elements.

Figure 3:
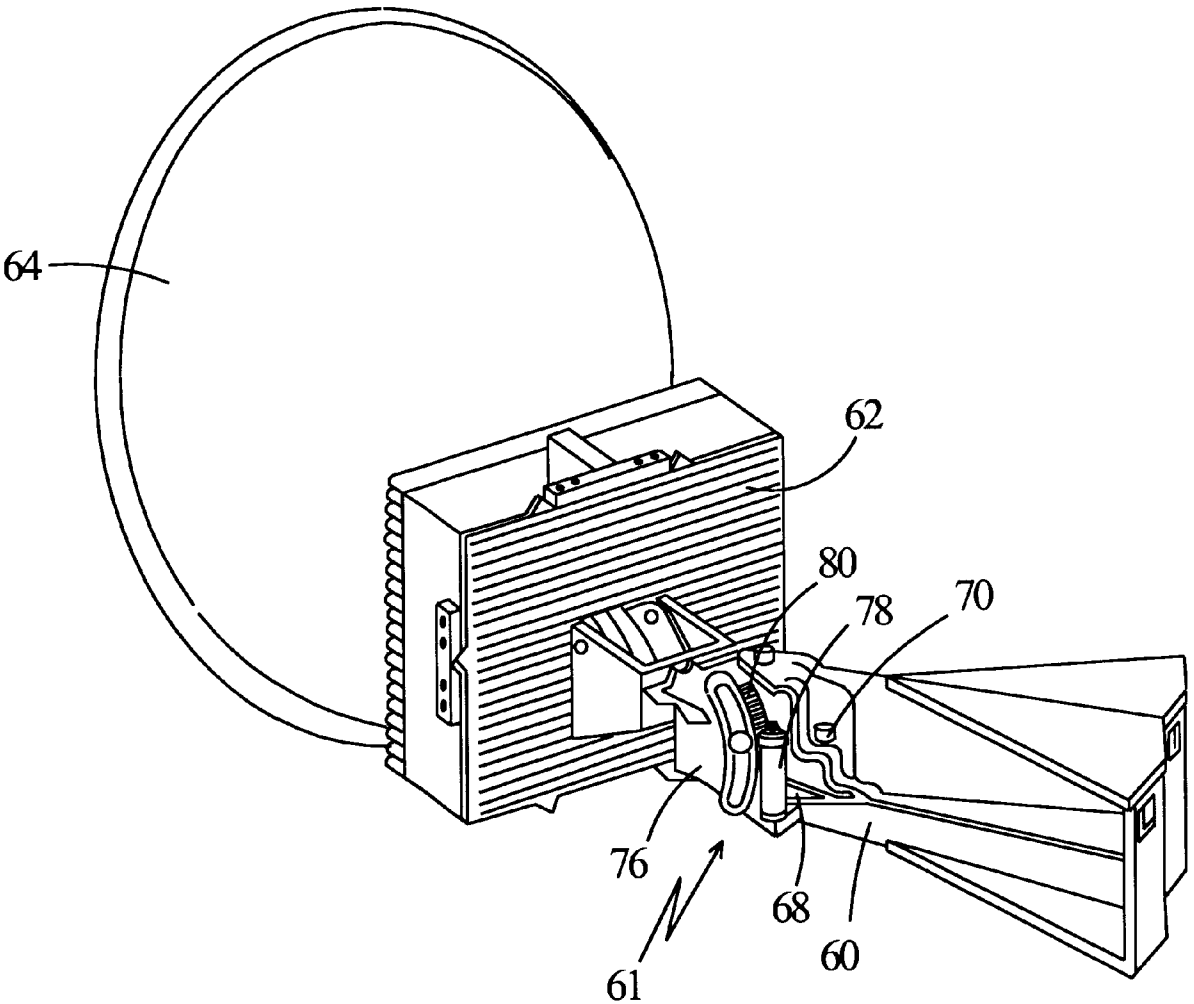
FIG. 3 is a pictorial view of an embodiment of a parabolic antenna mount of the present invention illustrating two degrees of adjustment.
Figure 4:
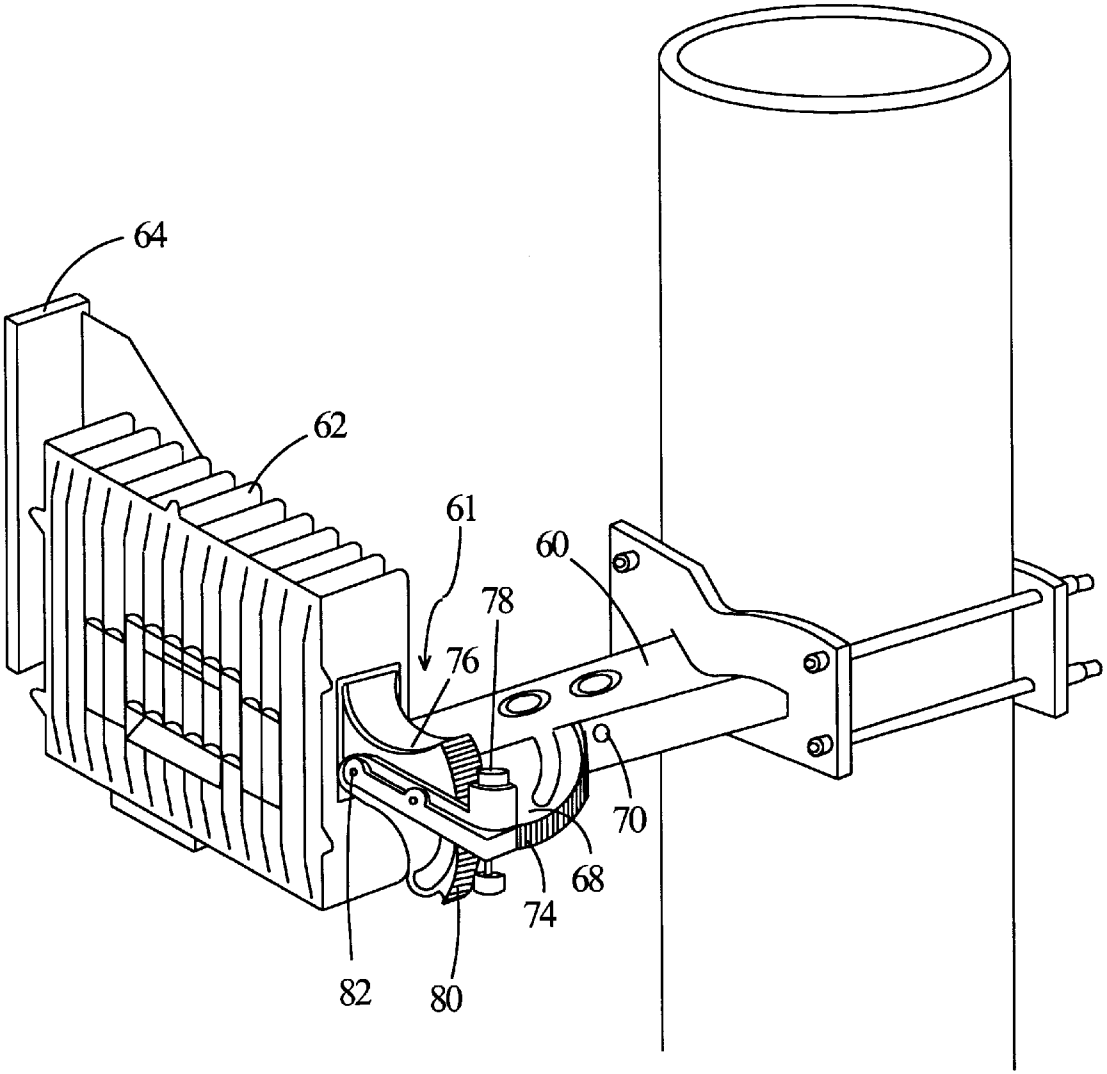
FIG. 4 is a pictorial view of an embodiment of a dipole antenna mount of the present invention illustrating two degrees of adjustment.
Figure 5:
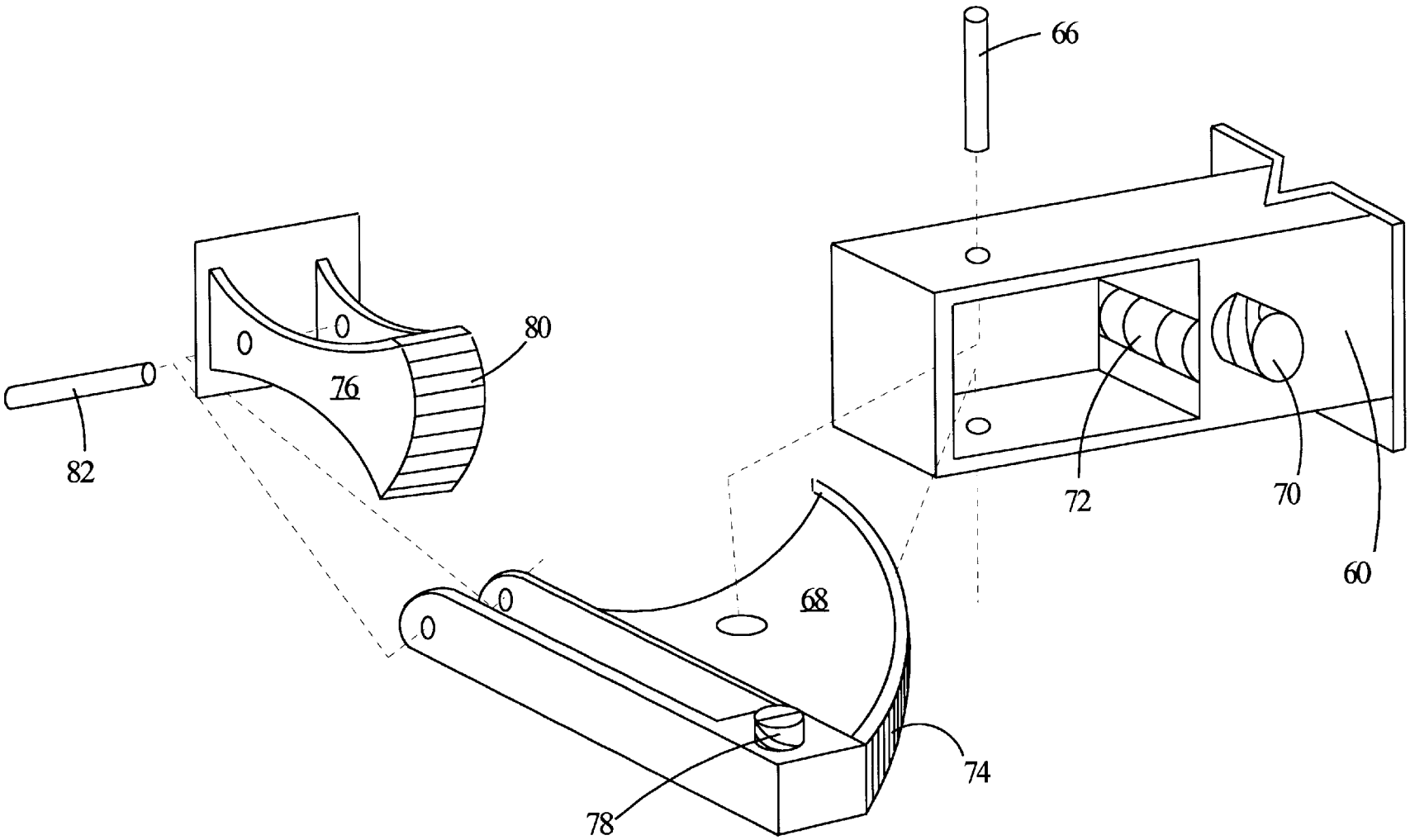
FIG. 5 is a schematic exploded view of one mechanism for achieving the two degrees of adjustment in the embodiments of FIG. 3 and FIG. 4.

In the embodiment shown in FIG. 2, adjustments in elevation must be made by the adjustment of the antenna bracket 10 to the pole 12 or the individual antennas (not shown) to the bracket 10. However, FIGS. 3–5 illustrate an antenna bracket which facilitates adjustments in both elevation and azimuth. With reference to FIGS. 3–5 where like functional elements have been given like numeric designations, the pole mounting bracket 60 may be attached to the pole or other supporting structure in any suitable conventional way such as the manner illustrated in FIG. 2. The pole mounting bracket 60 supports the antenna mount 61 in the manner to be described infra. The antenna unit 62 including the actual antenna 64 is in turn supported by antenna mount 61.

As shown in FIGS. 3 and 4 and schematically illustrated in FIG. 5, the pole bracket 60 includes a pivotal support 66 for a first adjustment member 68 the manually rotatable knob 70 of a threaded screw 72.

The first adjustable member 68 carries an arcuate threaded surface 74 which mates with the screw 72 when the first adjustable member is pivotally supported by the pin 66. In this way, the manual rotation of the knob 70 effects rotation of the first adjustable member 68 about the pin 66 to position the antenna in one orthogonal direction, azimuth or elevation as determined by the orientation of the pole mount 60.

The first adjustable member includes a pivotal support for a second adjustable member 76 and included a threaded manually operable knob 78 for a screw which engages a threaded arcuate surface 80 on the second adjustment member 76. In this way, rotation of the knob 78 effects rotation of the second adjustment member about the pin 872 to provide a second degree of adjustment orthogonal to the degree of adjustment provided by the first adjustment member 68.

The latching of the antenna unit to the second adjusting member may be accomplished in several ways. However, it is highly desirable that the antenna be quickly and easily replaced in both an individual node mount or as an element in a hub array. The quick disconnect latch shown in FIGS. 3 and 4 is illustrated more clearly in FIGS. 6–8 and the operation thereof is schematically illustrated in FIG. 9.

Figure 6:
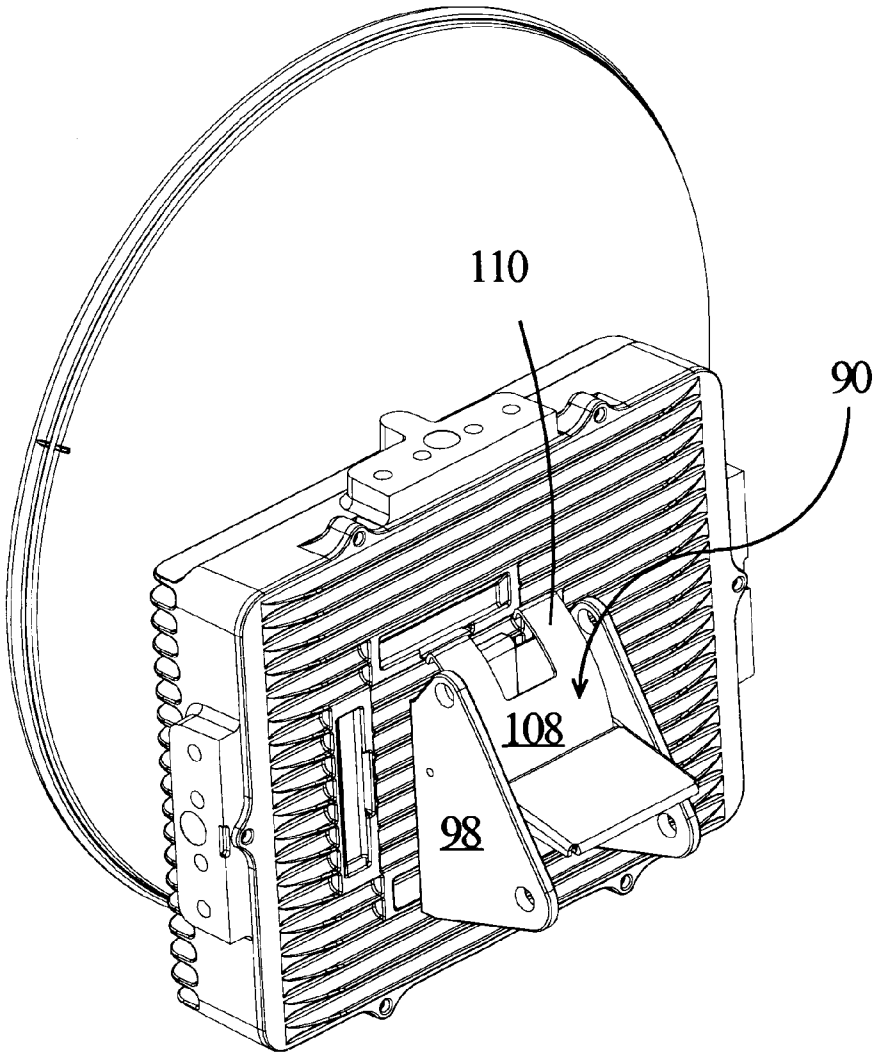
FIG. 6 is a pictorial view of one embodiment of the quick connect/disconnect latch mechanism of the present invention in the open position.
Figure 7:
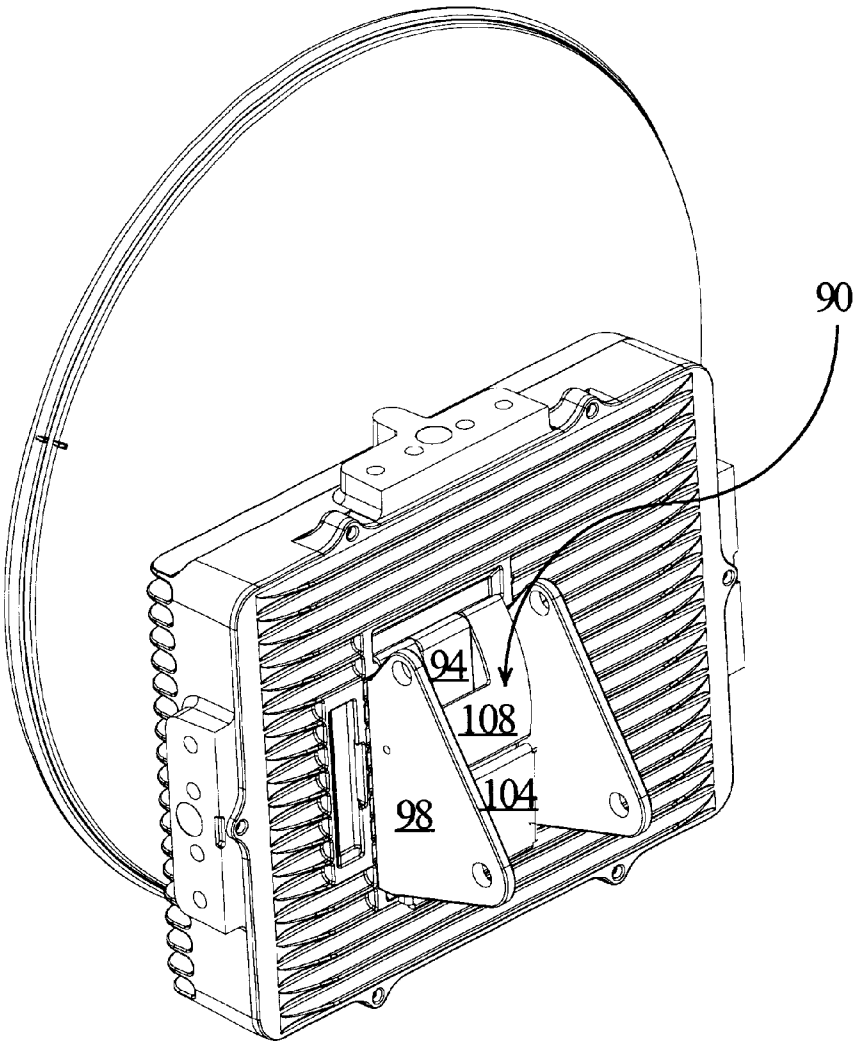
FIG. 7 is a pictorial view of the embodiment of the quick connect/disconnect latch mechanism illustrated in FIG. 6 in the latched or closed position.
Figure 8:
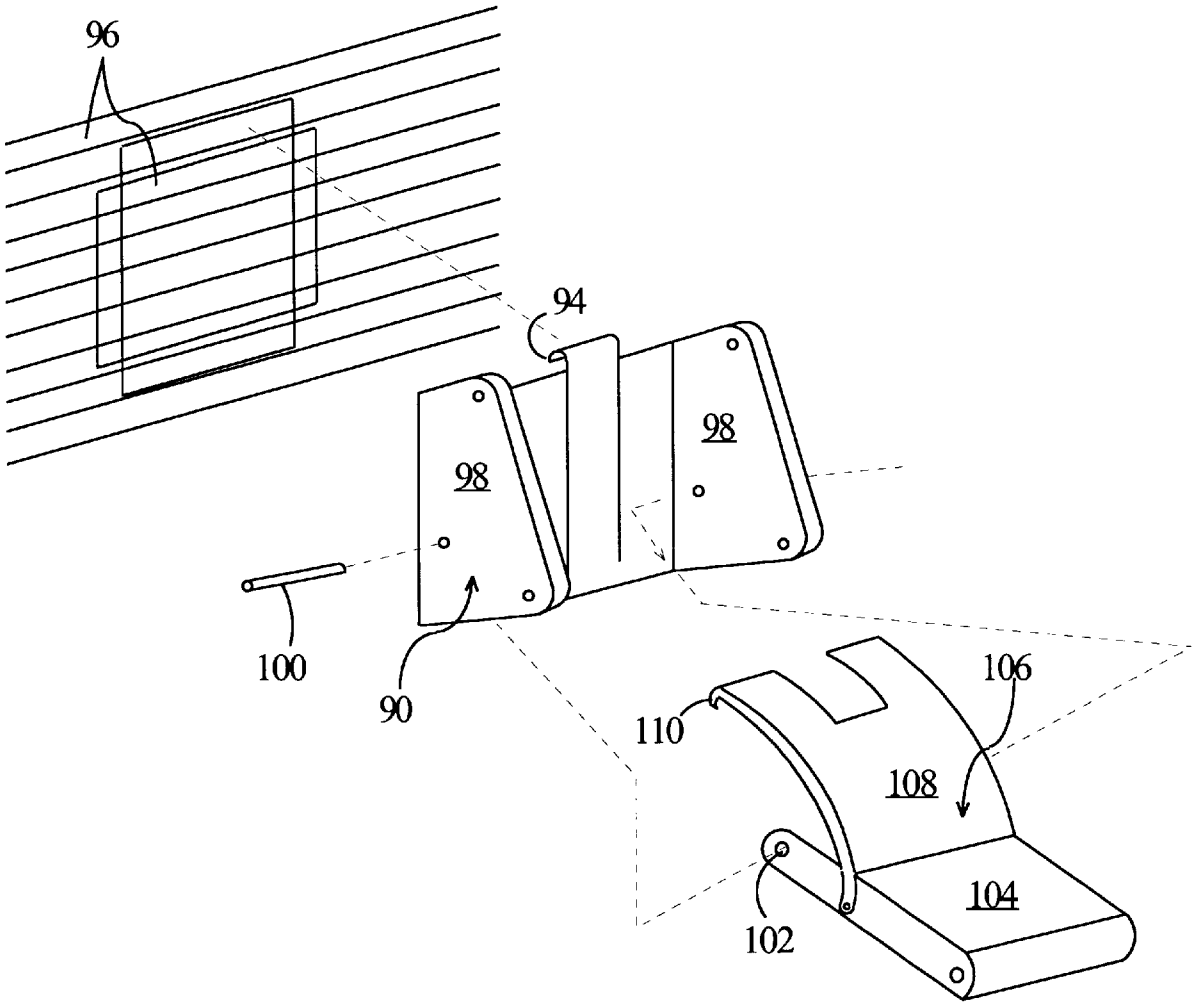
FIG. 8 is a schematic exploded illustration of the embodiment of the latch illustrated in FIGS. 6 and 7.

With reference to FIGS. 6–8, the latch generally includes a first member 90 adapted to be carried by the second adjustment member of the mounts of FIGS. 3–5. The first member 90 includes a first forward facing hook (92 in FIG. 9) at the lower edge of the center section (not shown) adapted to engage an element on the antenna. The center section of the first member also desirably carries a spring biased element 94 adapted to engage one of the slots 96 in the antenna to provide stability of the antenna during the latching operation.

The flanges 98 of the first member 90 may be provided with apertures to receive a pin 100 which passes through a hole 102 adjacent one end of the flat member 104 of a second member 106 so that the flat member may pivot about the pin 100. Approximately midway along the flat member 104 is hinged a curved member 108 which has at the distal end thereof a second hook 110 adapted to engage an element of the antenna. Alternatively, suitable protrusions from the sides of the flat member 104 may engage a detent on the curved member 108 to provide the pivotal connection.

Figure 9:
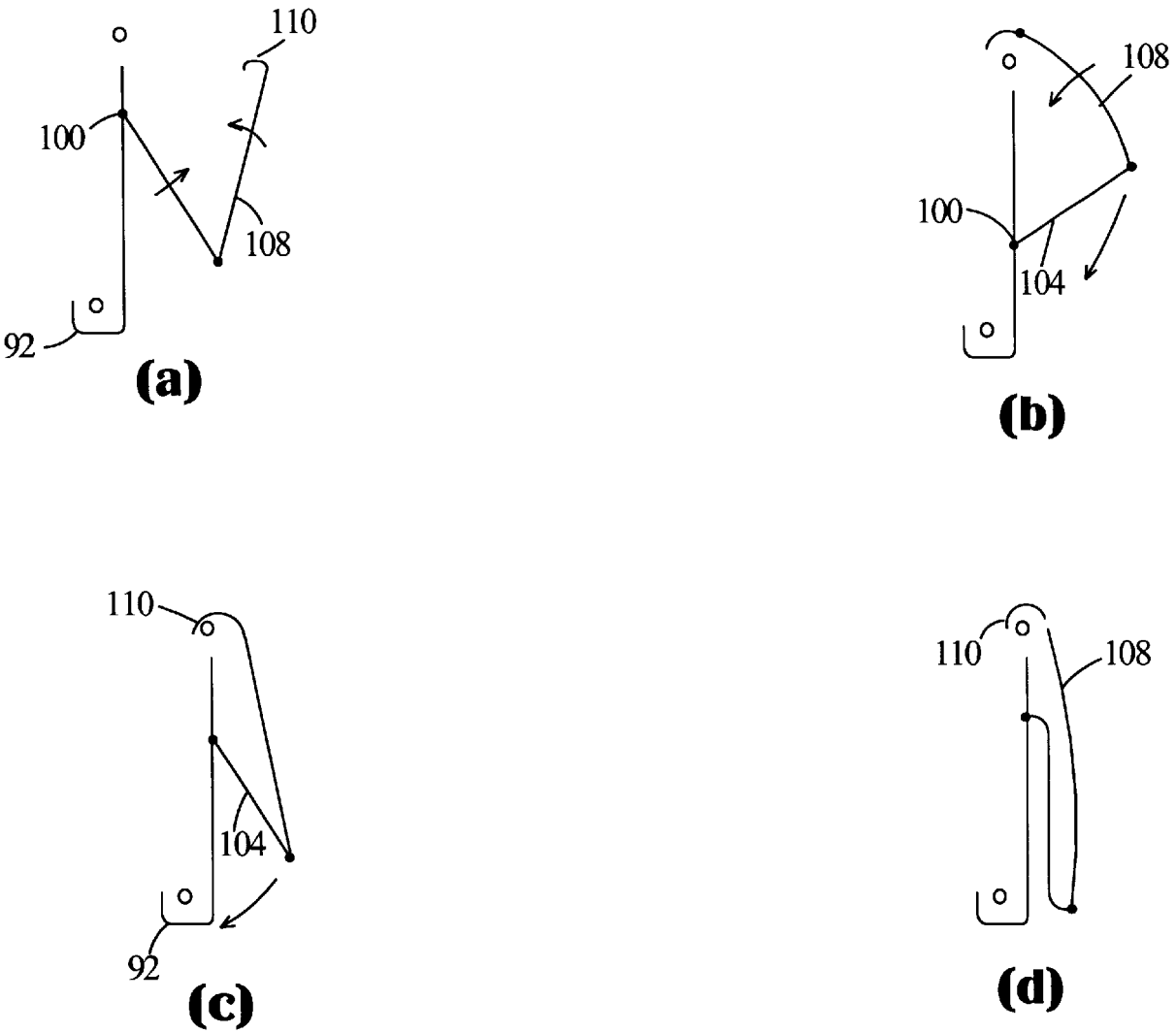
FIGS. 9(*a*) through 9(*d*) are schematic illustrations of the operation of the embodiment of the quick connect/disconnect latch mechanism of FIGS. 6–8.

In operation, and as shown in FIG. 9(*a*), the first member is placed against the antenna with the lower hook 92 engaged and both the flat member 104 and the curved member 108 out of contact with the antenna. As shown in FIG. 9(*a*), both the flat and curved members may then be rotated counterclockwise to position the hook 110 in position to engage the antenna. Once the hook 110 is engaged, the flat member 104 may be rotated clockwise into the latched position shown in FIG. 9(*d*) and in FIG. 7.

As shown in various of the figures, the antenna is desirably provide with latch receiving means on the back, ends and sides so that the antenna may be selectively latched to the mounting member in the orientation dictated by the antenna element itself.

It should be understood that the foregoing description of preferred embodiments is illustrative only and that various changes, substitutions and alterations can be made herein without departing from the spirit and scope of the invention as defined by the appended claims.

What is claimed is:

1. An antennae mounting system for an array of hub antennae in a point-to-multipoint millimeter wave communications system, comprising:

a first generally C-shaped bracket adapted to be mechanically secured to a supporting structure, said bracket having at least one preformed hole extending through the upper flange thereof coaxially aligned with a preformed hole in the lower flange thereof;

a second generally C-shaped bracket adapted for supporting at least one hub antenna in one of a plurality of preselected positions relative thereto, said second bracket having at least one preformed hole extending generally normal through the upper flange thereof in coaxial alignment with a preformed hole extending through the lower flange thereof, said first and second bracket being configured to nest with the lower flange of one of said brackets being supported by the lower flange of the other of said brackets with a preformed hole in the upper and lower flanges of one of said brackets coaxially aligned with a preformed hole in the upper and lower flange of the other of said brackets; and a connector for connecting the said two brackets, said connector comprising an elongated housing having an internal spring and a pin extending axially from both ends thereof, at least one of said pins being biased by said spring into an extended position and being sufficiently axially compressible into a retracted position for said housing to be manually inserted between the uppermost one of said lower flanges and the lowermost one of said upper flanges with one of said pins protruding through an aligned hole in said upper flanges and the other of said pins protruding through aligned holes in said lower flanges, to thereby pivotably connect said two brackets.

2. The system of claim 1 wherein at least one pair of adjacent flanges includes at least one azimuth fixing preformed hole selectively rotatable into coaxial alignment with each other so that the relative pivotable position of said two brackets may be fixed by the insertion of an object thereinto.

3. The system of claim 2 wherein each pair of adjacent flanges includes two azimuth fixing preformed holes, one each on opposite sides of said pin receiving holes, said azimuth fixing holes being selectively rotatable into coaxial alignment so that the relative pivotable position of said two brackets may be fixed by the insertion of an object thereinto.

4. The system of claim 1 wherein at least one flange of said second bracket includes a plurality of spaced apart pairs of holes with each pair of holes defining a predetermined angle with respect to said second bracket, to thereby facilitate the mounting of a plurality of hub antennae on a single bracket at a predetermined angles with respect to each other in a generally horizontal plane.

5. The system of claim 1 wherein both flanges of said second bracket includes a plurality of spaced apart pairs of holes with each pair of holes defining a predetermined angle with respect to said second bracket, to thereby facilitate the mounting of a plurality of hub antennae on both the upper and lower flanges of a single bracket at a predetermined angles with respect to each other in a generally horizontal plane with different elevational angles between the antennae on said upper and lower brackets.

6. An antenna mounting system comprising a pair of nestable brackets with coaxially aligned holes and a pin connector for pivotably connecting said two brackets for relative movement in a generally horizontal plane, said connector comprising an elongated housing with spring biased pin extending axially from both ends thereof, said connector being adapted to be manually positioned with one on said pins extending upwardly through aligned holes in said brackets and the other of said pins extending downwardly through aligned holes in said brackets, to thereby pivotably connect said two brackets.

7. A connector for pivotably connecting two brackets of an antenna mount with spaced apart flanges comprising:

an elongated hollow body;

an elongated spring contained inside said body; and two pins, each pin extending from one end of said body under the bias of said spring, being restrained by said body against complete extraction therefrom, said spring being sufficiently manually compressible for said pins to be enclosed by said body during the insertion of said connector between the spaced apart flanges of said brackets.

8. A method of mounting at least one directional antenna in a point-to-multipoint millimeter wave communication system for the selected positioning thereof comprising the steps of:

(a) securing a first mounting bracket on a suitable platform;

(b) connecting a second mounting bracket to the first mounting bracket by a pivotal connector, so that the second bracket may be pivoted to thereby selectively position the directional antenna;

wherein the pivotal connector comprises:

an elongated hollow body;

an elongated spring contained inside said body; and two pins, each pin extending from one end of said body under the bias of said spring and being restrained by said body against complete extraction therefrom, said spring being sufficiently manually compressible for said pins to be enclosed by said body during the interconnection of the brackets.

9. The method of claim 8 including the further step of mounting at least one antenna on the second mounting bracket.

10. A method of mounting an antenna comprising the steps of:

(a) securing a first apertured bracket to a support structure;

(b) positioning a second bracket with respect to the first bracket so that the weight of the second bracket is supported by the first bracket; and (c) interconnecting the first and second brackets by an elongated connector with at least one spring biased pin extending through the apertures in the brackets.

11. The method of claim 10 wherein the first and second bracket include spaced apart coaxial apertures;

wherein the connector includes a spring biased pin extending coaxially from the connector; and wherein each pin extends through an aperture in both brackets when the brackets are interconnected;

securing an antenna to the second apertured bracket.

12. The method of claim 11 including the further step of securing at least one antenna to the second apertured bracket.

13. The method of claim 10 including the further step of securing at least one antenna to the second apertured bracket.

* * * * *